US009449741B2

(12) United States Patent
Abe et al.

(10) Patent No.: US 9,449,741 B2
(45) Date of Patent: Sep. 20, 2016

(54) COAXIAL CABLE WITH PROTRUDING PORTIONS OF INSULATING FOAM

(71) Applicant: HITACHI METALS, LTD., Tokyo (JP)

(72) Inventors: Masahiro Abe, Hitachi (JP); Sohei Kodama, Hitachi (JP); Akinari Nakayama, Hitachinaka (JP)

(73) Assignee: HITACHI METALS, LTD., Tokyo (JP)

( * ) Notice: Subject to any disclaimer, the term of this patent is extended or adjusted under 35 U.S.C. 154(b) by 50 days.

(21) Appl. No.: 14/305,265

(22) Filed: Jun. 16, 2014

(65) Prior Publication Data

US 2014/0367140 A1 Dec. 18, 2014

(30) Foreign Application Priority Data

Jun. 17, 2013 (JP) ..... 2013-126477

(51) Int. Cl.
*H01B 11/18* (2006.01)

(52) U.S. Cl.
CPC ..... *H01B 11/1834* (2013.01); *H01B 11/1856* (2013.01); *H01B 11/1839* (2013.01); *H01B 11/1878* (2013.01)

(58) Field of Classification Search
CPC ..... H01B 11/1839; H01B 11/1808; H01B 11/1878; H01B 11/18; H01P 3/06
USPC ..... 174/110 R
See application file for complete search history.

(56) References Cited

U.S. PATENT DOCUMENTS

| | | | | |
|---|---|---|---|---|
| 2,890,263 | A * | 6/1959 | Hermann | H01B 11/1808 174/102 D |
| 7,205,479 | B2 * | 4/2007 | Caveney | H01B 11/04 174/110 R |
| 7,476,809 | B2 * | 1/2009 | Magner | H01B 7/184 174/120 R |
| 7,560,646 | B2 * | 7/2009 | Heffner | H01B 13/143 174/110 R |
| 7,795,539 | B2 * | 9/2010 | Thuot | H01B 7/0275 174/110 R |
| 2006/0213681 | A1 * | 9/2006 | Magner | H01B 7/184 174/120 R |
| 2009/0229851 | A1 * | 9/2009 | Thuot | H01B 13/143 174/107 |
| 2009/0233052 | A1 | 9/2009 | Thuot et al. | |
| 2013/0126209 | A1 * | 5/2013 | Heffner | H01B 11/06 174/113 R |
| 2015/0047874 | A1 | 2/2015 | Thuot et al. | |

FOREIGN PATENT DOCUMENTS

| | | |
|---|---|---|
| CN | 101978432 A | 2/2011 |
| JP | 2012-169771 A | 9/2012 |

OTHER PUBLICATIONS

Andrew Catalog 38 Coaxial Cables section (Heliax).*
Chinese Office Action, Jul. 15, 2016, 12 pages.

* cited by examiner

*Primary Examiner* — Timothy Thompson
*Assistant Examiner* — Michael F McAllister
(74) *Attorney, Agent, or Firm* — Foley & Lardner LLP

(57) ABSTRACT

A coaxial cable includes a center conductor, an insulating foam provided to cover an outer periphery of the center conductor, and a protruding portion provided around an outer surface of the insulating foam to absorb stress. The protruding portion has a waved shape that oscillates in a circumferential direction of the insulating foam.

6 Claims, 6 Drawing Sheets

COAXIAL CABLE WITH PROTRUDING PORTIONS OF INSULATING FOAM

The present application is based on Japanese patent application No. 2013-126477 filed on Jun. 17, 2013, the entire contents of which are incorporated herein by reference.

BACKGROUND OF THE INVENTION

1. Field of the Invention

This invention relates to a coaxial cable which has an excellent flexibility.

2. Description of the Related Art

In general, a coaxial cable is configured as including a center conductor (inner conductor), an insulating foam which is provided to cover an outer periphery of the center conductor, an outer conductor which is provided to cover an outer periphery of the insulating foam, and a sheath which is provided to cover an outer periphery of the outer conductor. Further, the coaxial cable is configured in such a manner that the center conductor, the insulating foam, the outer conductor, and the sheath are coaxially structured. As the outer conductor and the center conductor of the coaxial cable, e.g. a copper pipe or the like is used, which is formed by making a copper plate or a copper alloy plate tubular. Accordingly, there is a disadvantage in that the flexibility of the coaxial cable is low so that the coaxial cable is not easily bent. For example, when the coaxial cable is installed in a narrow space, the installation may be difficult to perform (i.e., the workability is low). Also, for example, when the coaxial cable is wound around a take-up roll, it may be necessary to increase the diameter of the take-up roll, which is likely to lower the handling easiness of the coaxial cable.

Thus, a technique has been disclosed that improves the flexibility of the coaxial cable, with a braided layer formed as the outer conductor by braiding a metal wire such as copper or a copper alloy by e.g. JP-A-2012-169771.

SUMMARY OF THE INVENTION

However, even this coaxial cable has been low in flexibility, which has lowered the workability and handling easiness of the coaxial cable.

Accordingly, it is an object of the present invention to provide a coaxial cable, which overcomes the foregoing problem, and which has an excellent flexibility.

(1) According to an embodiment of the invention, a coaxial cable comprises:

a center conductor;

an insulating foam provided to cover an outer periphery of the center conductor; and a protruding portion provided around an outer surface of the insulating foam to absorb stress, wherein the protruding portion comprises a waved shape that oscillates in a circumferential direction of the insulating foam.

In the embodiment, the following modifications and changes can be made.

(i) The protruding portion is provided in a longitudinal direction of the insulating foam.

(ii) The protruding portion comprises a helical shape in a central axis direction of the insulating foam.

(iii) The protruding portion comprises two or more and a distance between adjacent protruding portions is not smaller than 1.5 mm and not greater than 10.75 mm.

(iv) The coaxial cable further comprises:

an outer conductor provided around an outer periphery of the insulating foam to cover the outer periphery of the insulating foam, wherein the protruding portion comprises a shape in which a contact area with the outer conductor is smaller than a contact area in an entire surface contact at a cross section in a direction perpendicular to a longitudinal direction of the insulating foam.

(v) A bend pitch of the protruding portion is not smaller than 10 mm and not greater than 20 mm.

(vi) A height of the protruding portion is not smaller than 0.1 mm and not greater than 0.5 mm, and a width of the protruding portion is not smaller than 1.0 mm and not greater than 10 mm.

POINTS OF THE INVENTION

The coaxial cable according to the invention has an excellent flexibility.

BRIEF DESCRIPTION OF THE DRAWINGS

The preferred embodiments according to the invention will be explained below referring to the drawings, wherein:

FIG. 3A and FIG. 3B are schematic diagrams showing the insulating foam of the coaxial cable in one embodiment according to the present invention, wherein FIG. 3A is a cross sectional view of the insulating foam of the coaxial cable in a direction perpendicular to a longitudinal direction, and FIG. 3B is a top view showing the insulating foam of the coaxial cable;

DETAILED DESCRIPTION OF THE PREFERRED EMBODIMENTS

Next, a coaxial cable in one embodiment according to the invention will be described below in conjunction with the appended drawings.

(1) Configuration of the Coaxial Cable

First, a configuration of a coaxial cable in one embodiment according to the present invention will be described mainly with reference to FIGS. 1 to 4.

Figure 1:
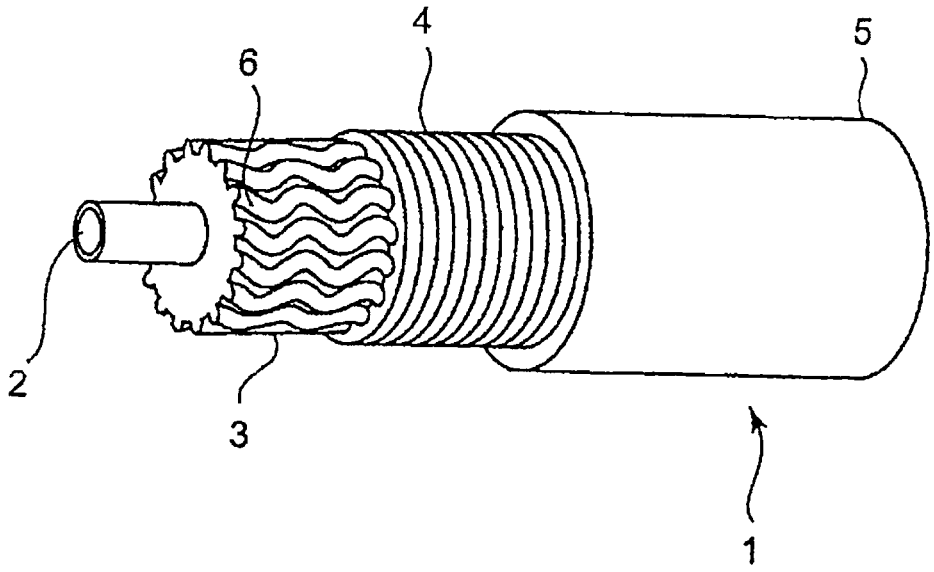
FIG. 1 is a schematic perspective view showing a coaxial cable in one embodiment according to the present invention.

As shown in FIG. 1, the coaxial cable 1 in the present embodiment comprises a center conductor (inner conductor) 2, an insulating foam 3, an outer conductor 4, and a sheath 5. That is, the coaxial cable 1 is configured in such a manner that the center conductor 2, the insulating foam 3, the outer conductor 4, and the sheath 5 are coaxially structured.

As the center conductor 2, e.g. a copper material (copper pipe), which is molded in a hollow pipe shape, a copper material, which is molded in a rod shape, or the like may be used. Besides, as the center conductor 2, e.g. a lead wire, which is a wire including a copper or aluminum wire, a stranded wire, which comprises a plurality of wires twisted together, or the like may be used.

Figure 2:
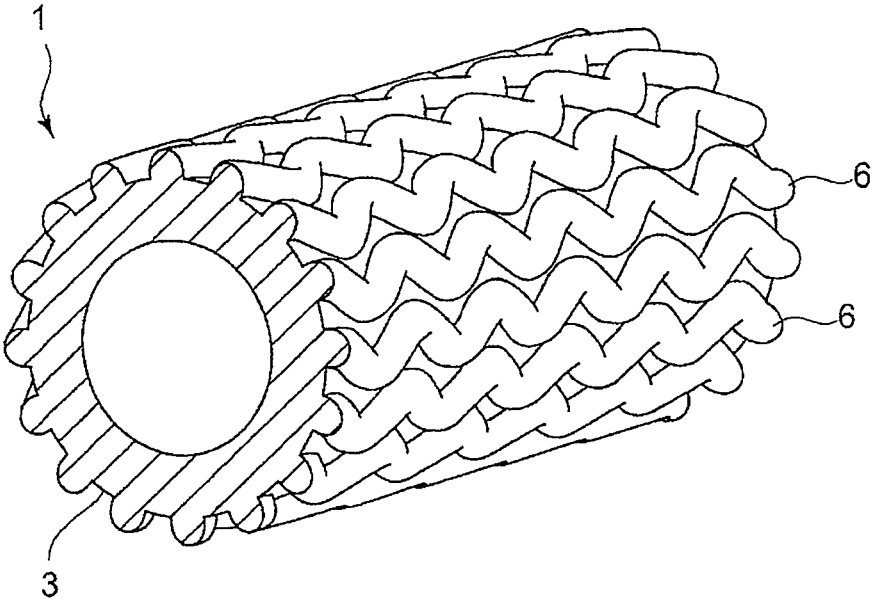
FIG. 2 is a schematic perspective view showing an insulating foam of the coaxial cable in one embodiment according to the present invention.

The insulating foam 3 is provided around an outer periphery of the center conductor 2 to cover the outer periphery of the central conductor 2. As shown in FIGS. 1 to 3, protruding portions 6 are provided around an outer surface of the insulating foam 3. The protruding portions 6 are formed in a waved shape that oscillates in a circumferential direction of the insulating foam 3. That is, the protruding portions 6 are formed in such a manner to be periodically bent (curved) in the circumferential direction of the insulating foam 3. Further, the protruding portions 6 may be formed along a longitudinal direction of the insulating foam 3.

Thus, for example, when an external force such as bending force is applied to the coaxial cable 1, the protruding portions 6 are deformed, and the protruding portions 6 absorb stress caused in the coaxial cable 1. That is, when the external force is applied to the coaxial cable 1 so that the external force collides with the protruding portions 6, the external force is dispersed along the protruding portions 6 and in a plurality of directions, and the protruding portions 6 are deformed in such a manner that the distances between the plurality of vertices of the protruding portions 6 become short and long. Therefore, the flexibility of the coaxial cable 1 is enhanced, and the coaxial cable 1 is likely to be bent.

Figure 3A:
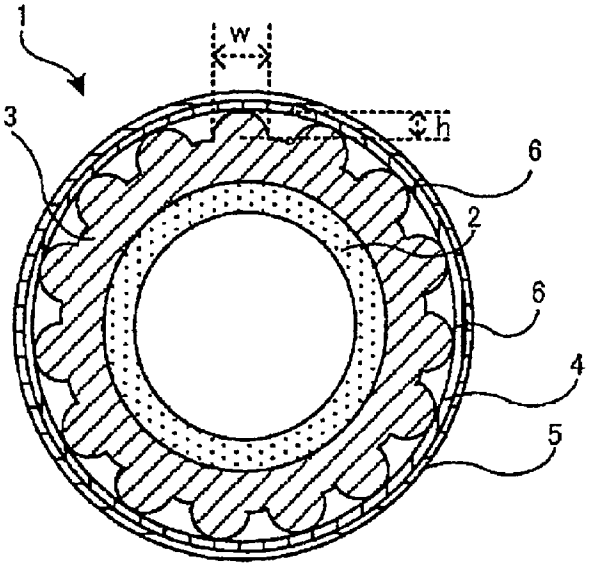
Figure 3B:
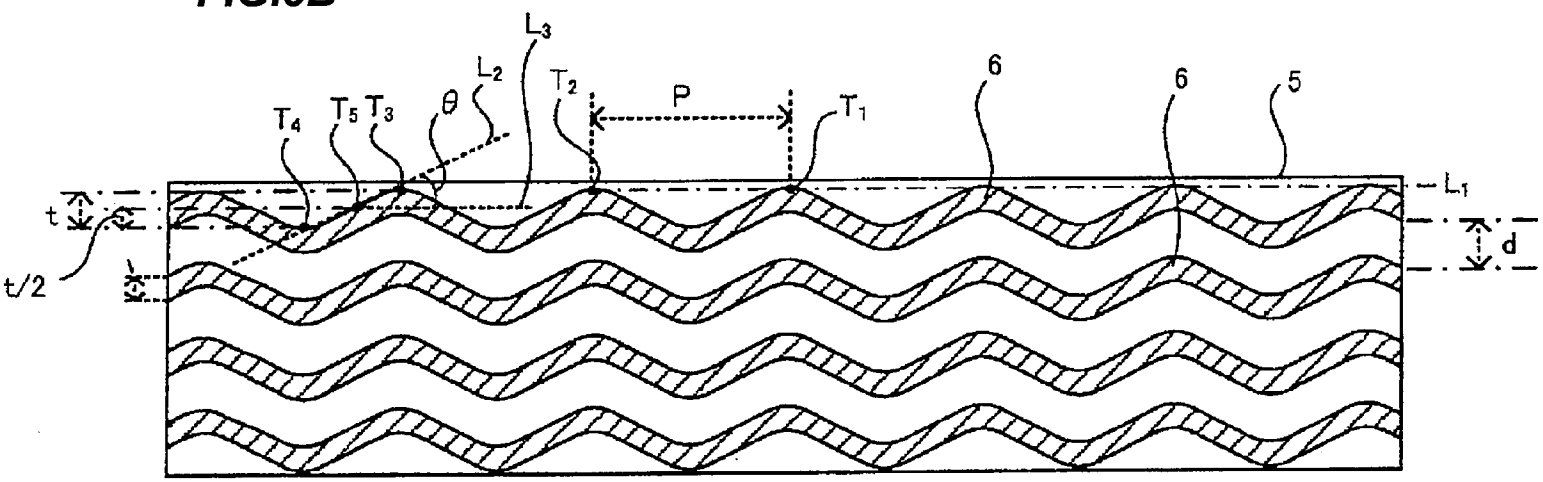

A plurality of the protruding portions 6 may be formed at a predetermined pitch in the circumferential direction of the insulating foam 3. The plurality of protruding portions 6 may each be formed to be parallel to the longitudinal direction of the insulating foam 3. At this point, as shown in FIG. 3B, the distance (shortest distance) d between the adjoining protruding portions 6, 6 may be not smaller than 1.5 mm and not greater than 10.75 mm, preferably, not smaller than 5.0 mm and not greater than 7.0 mm. Thus, when the external force is applied to the coaxial cable 1, the protruding portions 6 are more likely to absorb stress caused in the coaxial cable 1. Therefore, it is possible to further enhance the flexibility of the coaxial cable 1. Incidentally, if the distance d between the adjoining protruding portions 6, 6 is less than 1.5 mm, the number of the protruding portions 6 is too large, and the protruding portions 6 interfere with each other, therefore leading to lowering in the flexibility of the coaxial cable 1. If the distance d between the adjoining protruding portions 6, 6 exceeds 10.75 mm, the number of the protruding portions 6 is small, therefore being likely to cause the protruding portions 6 to collapse when the external force acts thereon, though the flexibility of the coaxial cable 1 is enhanced.

Figure 4:
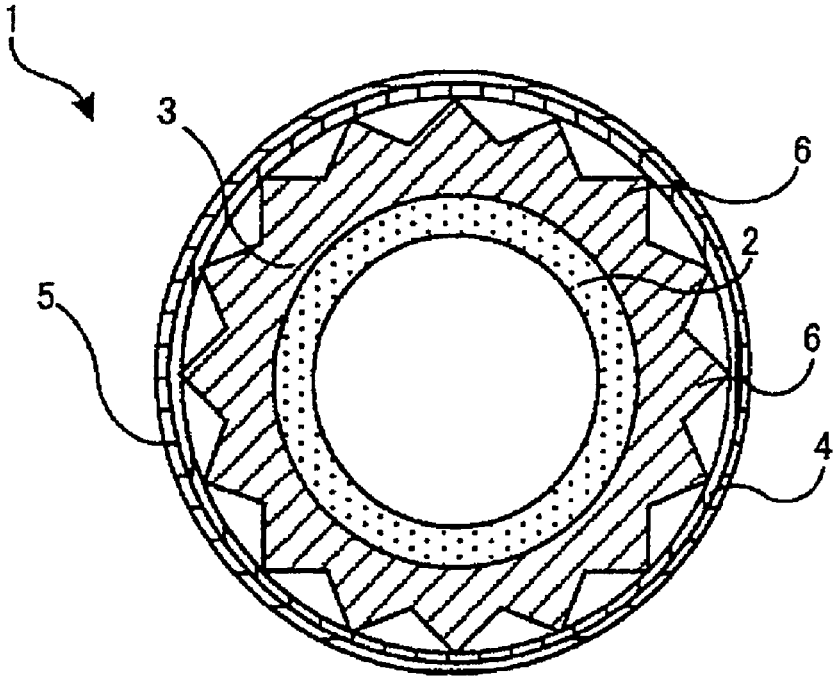
FIG. 4 is a schematic view showing a modification to the insulating foam of the coaxial cable in one embodiment according to the present invention.

The protruding portions 6 may have such a shape that their contact area with the outer conductor 4 to be described later which is provided to cover the outer periphery of the insulating foam 3 is small. For example, the protruding portions 6 may have such a shape as to be in point contact with the outer conductor 4 at a cross section in a direction perpendicular to the longitudinal direction of the insulating foam 3, i.e., in a circumferential direction. Specifically, as shown in FIG. 3A, the protruding portions 6 may be formed in a semicircular shape at a cross section in a direction perpendicular to the longitudinal direction of the insulating foam 3. Besides, as shown in FIG. 4, the cross-sectional shape of the protruding portions 6 may be e.g. a triangular shape. Also, the cross-sectional shape of the protruding portions 6 may be formed in a trapezoidal shape or the like. Thus, when an external force is applied to the coaxial cable 1, the friction force caused between the outer conductor 4 and the insulating foam 3 is reduced. Therefore, the insulation foam 3 is likely to slip in the outer conductor 4. In other words, the insulation foam 3 is easy to move in the outer conductor 4. As a result, the coaxial cable 1 is more likely to be bent, and it is possible to further enhance the flexibility of the coaxial cable 1.

In contrast, if the contact area between the outer conductor 4 and the insulating foam 3 is large, e.g., if the insulating foam 3 is in surface contact with the outer conductor 4, when the external force is applied to the coaxial cable 1, the frictional force caused between the outer conductor 4 and the insulating foam 3 is significant. For this reason, the insulation foam 3 is less likely to move in the outer conductor 4, and the coaxial cable 1 is less likely to be bent. Further, when an external force is applied to the coaxial cable 1, the coaxial cable 1 is easily buckled.

As shown in FIG. 3B, the protruding portions 6 may be formed in such a manner that the bending pitch P is not smaller than 10 mm and not greater than 20 mm, e.g., 16.2 mm. It should be noted that the bending pitch P of the protruding portions 6 is the shortest distance between the adjacent vertices $T_1$ and $T_2$ on one line $L_1$ parallel to the longitudinal direction of the insulating foam 3. Thus, since the protruding portions 6 are more likely to absorb stress caused in the coaxial cable 1, it is possible to further enhance the flexibility of the coaxial cable 1. Incidentally, if the bending pitch P of the protruding portions 6 is less than 10 mm, the number of vertices of the protruding portions 6 is too large, therefore being less likely to deform the protruding portions 6 in such a manner that the distances between the vertices of the protruding portions 6 become short and long, when an external force acts thereon. Therefore, the flexibility of the coaxial cable 1 lowers. Further, if the bending pitch P of the protruding portions 6 is more than 20 mm, the coaxial cable 1 is easily buckled when an external force is applied to the coaxial cable 1.

As shown in FIG. 3A, the protruding portions 6 may be formed in such a manner as to have a height h of not smaller than 0.1 mm and not greater than 0.5 mm, preferably not smaller than 0.2 mm and not greater than 0.4 mm. For example, the height h of the protruding portions 6 may be 0.2 mm, when the diameter of the insulating foam 3 (the diameter of the coaxial cable 1) is 35 mm. Further, the protruding portions 6 may be formed in such a manner as to have a width w of not smaller than 1.0 mm and not greater than 10 mm, preferably not smaller than 4.0 mm and not greater than 6.0 mm. For example, the width w of the protruding portions 6 may be 5.0 mm, when the diameter of the insulating foam 3 is 35 mm. Thus, since the protruding portions 6 are likely to absorb stress caused in the coaxial cable 1, it is possible to further enhance the flexibility of the coaxial cable 1. Incidentally, if the height h of the protruding portions 6 is less than 0.1 mm, the protruding portions 6 are less likely to absorb stress caused in the coaxial cable 1, therefore being likely to lower the flexibility of the coaxial cable 1. If the height h of the protruding portions 6 is more than 0.5 mm, when an external force is applied to the coaxial cable 1, the protruding portions 6 are likely to collapse. Further, if the width w of the protruding portions 6 is less than 1.0 mm, the protruding portions 6 are less likely to absorb stress caused in the coaxial cable 1. If the width w of the protruding portions 6 is more than 10 mm, the force is dispersed in the protruding portions 6, therefore being less likely to deform the protruding portions 6. For this reason, the protruding portions 6 are less likely to absorb stress caused in the coaxial cable 1, and the flexibility of the coaxial cable 1 is likely to lower.

The insulating foam 3 is formed by, e.g., foaming an insulating material having a low dielectric constant. As this insulating material, e.g. a polyolefin based resin may be used. As the polyolefin based resins, polyethylene, polypropylene, ethylene-propylene copolymer, block polypropylene, random polypropylene, implantable TPO, ethylene-propylene-butene copolymers, ethylene-butene copolymers, ethylene-octene copolymers, ethylene-hexene copolymers, and ethylene-pentene copolymers may be used. As the polyethylene, polyethylenes of each type, such as LDPE (low density polyethylene), HDPE (high density polyethylene), LLDPE (linear low density polyethylene), MDPE (medium density polyethylene), UHMWPE (ultra high molecular weight polyethylene) may be used solely or as mixture thereof. For example, as the insulating material, the MDPE and the LDPE may be used by being mixed at a ratio of 70/30 to 90/10.

As a method for foaming the insulating material, there are a physically foaming method (physical foaming) and a chemically foaming method (chemical foaming). The physical foaming is a foaming method by, e.g. injecting (press-fitting) a foaming gas into an insulating material in an extruder under a high pressure greater than atmospheric pressure, dissolving the foaming gas in the insulating material, and thereafter releasing this insulating material under atmospheric pressure. As the foaming gas, e.g. an inert gas such as carbon dioxide ($CO_2$) gas, nitrogen ($N_2$) gas, argon (Ar) gas or the like may be used. At this point, the injection pressure of the foaming gas can appropriately be adjusted according to degree of foaming of the insulating foam 3, type of the insulating material, and the like. Further, when the insulating material is physically foamed, a foam nucleating agent may be added to the insulating material. The chemical foaming is a foaming method by mixing and dispersing a chemically foaming agent in an insulating material with an extruder, and heating the chemically foaming agent dispersed in the insulating material during kneading to a temperature higher than a decomposition temperature of the chemically foaming agent to cause a decomposition reaction of the chemically foaming agent and use a gas produced by the decomposition of the chemically foaming agent. The chemically foaming agent is not particularly limited, but various known chemically foaming agents may be used.

In the insulating material which constitutes the insulating foam 3, besides the foam nucleating agent and the foaming agent (chemically foaming agent), e.g., an antioxidant, a viscosity modifier, a thickener, a reinforcing agent, a filler, a plasticizer (softener), a vulcanizing agent, a vulcanization accelerator, a crosslinking agent, a crosslinking aid, a foaming aid, a processing aid, an anti-aging agent, a heat stabilizer, a weathering stabilizer, an antistatic agent, a lubricant, other additives, etc. may be added.

Around an outer periphery of the insulating foam 3, the outer conductor 4 is provided to cover the outer surface of the insulating foam 3. As the outer conductor 4, e.g. a copper material (copper pipe) which is formed in a cylindrical shape may be used. It should be noted that the outer conductor 4 may be corrugated. Thus, it is possible to further enhance the flexibility of the coaxial cable 1.

Around an outer periphery of the outer conductor 4, the sheath (outer cover) 5 is provided to cover the outer surface of the outer conductor 4. The sheath 5 is formed by, e.g., extrusion molding a resin such as polyethylene (PE), ethylene-vinyl acetate copolymer (EVA), or polyurethane.

(2) Production Method of the Coaxial Cable

Subsequently, a method for producing the coaxial cable 1 in one embodiment according to the present invention will be described.

Insulation Foam Forming Step

The insulating foam 3 is formed by, e.g. using an extruder or the like, extrusion coating an insulating material to cover the outer periphery of the center conductor 2 such as a copper pipe. For example, first, the extruder is adjusted so that pressure therein is a high pressure above atmospheric pressure, and under this high pressure, a foaming gas is injected into the insulating material in the extruder. Thus, the foaming gas is dissolved in the insulating material. Then, while the foaming gas is being injected into the insulating material, the insulating material with the foaming gas dissolved therein is extruded and coated to cover the outer periphery of the center conductor 2 delivered from, e.g. a feeder or the like. A gas is produced by the foaming gas dissolved in the insulating material being supersaturated when the insulating material extruded and coated around the outer periphery of the central conductor 2 is released from under the high pressure to the atmospheric pressure. Accordingly, the insulating material is foamed to form a foam layer. And the center conductor 2 formed with the foam layer is passed through inside, e.g., a hollow tube (cylindrical tube) for cooling a foam layer of a sizing die or the like, and the outer diameter of the foam layer is trimmed, and the foam layer is cooled and solidified. Thus, the insulating foam 3 is formed to cover the outer periphery of the central conductor 2.

Figure 5:
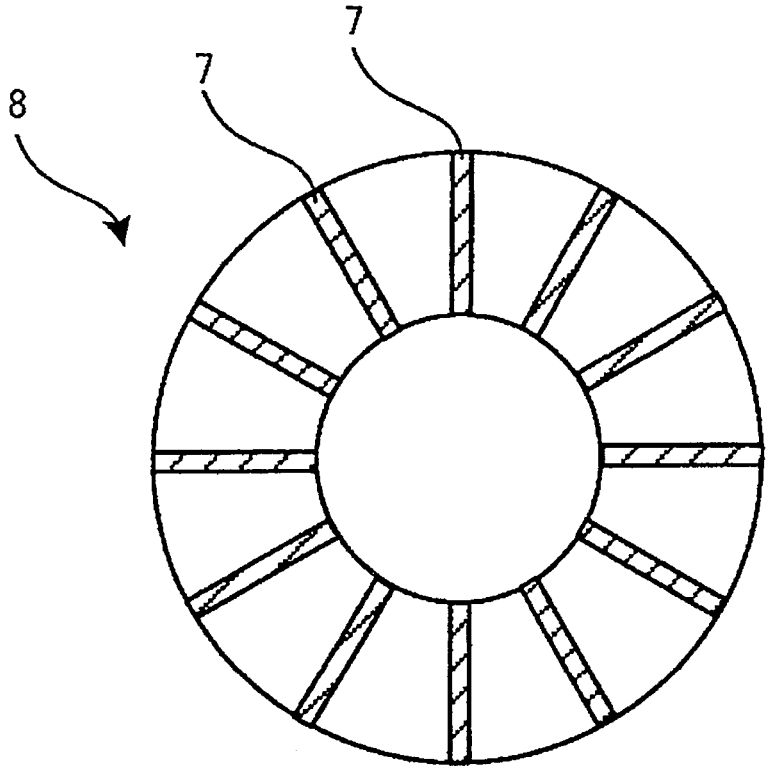
FIG. 5 is a schematic cross-sectional view showing a cap used in producing the coaxial cable in one embodiment according to the present invention.

The outlet of the extruder is provided with a cap 8 having an insulating material dividing member 7 as shown in FIG. 5. As the insulating material dividing member 7, e.g. a rod shaped member formed of SUS or the like, a thread like member, a branched member or the like may be used. Further, the insulating material dividing member 7 may be provided integrally with the cap 8 or may be provided detachably therefrom. By extruding the insulating material from the extruder around the outer periphery of the center conductor 2 through the cap 8, the insulating material is divided in the circumferential direction of the center conductor 2 and extruded to cover the outer periphery of the center conductor 2. By the insulating material extruded and coated around the outer periphery of the central conductor 2 being released from under the high pressure to the atmospheric pressure in this way, the foam layer having the protruding portions on its surface is formed. And by the foam layer having the protruding portions being passed through, e.g. a sizing die, the insulating foam 3 formed with the protruding portions 6 is formed on the outer surface of the central conductor 2. In addition, by changing the shape of the insulating material dividing member 7 (e.g., the length, width, etc. of the insulating material dividing member 7) of the cap 8, it is possible to appropriately variously change the cross-sectional shape (i.e. the cross section shape in the circumferential direction of the insulating foam 3), the height h, and the width w of the protruding portions 6. Further, by changing the number of the insulating material dividing members 7 of the cap 8, it is possible to adjust the number of the protruding portions 6 formed on the insulating foam 3, and the distance d between the adjoining protruding portions 6 and 6.

Further, while moving the center conductor 2 and rotating the cap 8 through a predetermined angle in the right and left direction, the insulating material is extruded and coated around the outer periphery of the central conductor 2. That is, the cap 8 is rotated around the axis in the moving direction of the center conductor 2 and in one direction (e.g. the clockwise direction) by the predetermined angle. Then, the cap 8 is rotated in the other direction (e.g. the counter-clockwise direction) by the predetermined angle. While repeating this operation, the cap 8 moves the center conductor 2. Thus, the protruding portions formed on the foam layer provided around the outer periphery of the center conductor 2 can be formed in the waved shape that oscillates in the circumferential direction of the center conductor 2. As a result, around the outer surface of the insulating foam 3, the protruding portions 6 in the waved shape that oscillates in the circumferential direction of the insulation foam 3 can be formed. In addition, by adjusting the rolling angle and the moving speed of the center conductor 2, it is possible to adjust the bending pitch P of the protruding portions 6 and the tangent angle θ of the protruding portions 6. It should be noted that the tangent angle θ refers to an angle between a tangent line $L_2$ at a point $T_5$ which is a position (t/2) which is half a distance t between adjacent vertices $T_3$ and $T_4$ in one protruding portion 6, and a line $L_3$ through the point $T_5$, and parallel to the longitudinal direction of the insulating foam 3.

As described above, when extrusion coating the insulating material around the outer periphery of the central conductor 2 using e.g. an extruder by using the cap 8 with the insulating material splitting member 7, and by moving while rolling the center conductor 2, around the outer surface of the insulating foam 3, the protruding portions 6 in the waved shape that oscillates in the circumferential direction of the insulation foam 3 can be formed.

Outer Conductor Forming Step

Subsequently, the outer conductor 4 is provided to cover the outer periphery of the insulating foam 3 and to be structured coaxially with the center conductor 2 and the insulating foam 3. As the outer conductor 4, e.g. a copper material (copper pipe), which is formed in a cylindrical shape may be used. Further, the outer conductor 4 may be corrugated.

Sheath Formation Process

The sheath 5 is formed by, e.g. extrusion molding a resin such as polyethylene (PE) to cover the outer periphery of the outer conductor 4, resulting in the coaxial cable 1. This results in the production process of the coaxial cable 1 of the present embodiment being ended.

(3) Effects of the Present Embodiment

The present embodiment has one or more effects described below.

(a) In the present embodiment, the protruding portions 6 in the waved shape that oscillates in the circumferential direction of the insulation foam 3 are formed around the outer surface of the insulating foam 3 provided to cover the outer periphery of the center conductor 2. Thus, when an external force such as bending force or the like is applied to the coaxial cable 1, the protruding portions 6 are deformed, and the protruding portions 6 absorb stress caused in the coaxial cable 1. Therefore, it is possible to enhance the flexibility of the coaxial cable 1.

(b) In the present embodiment, the protruding portions 6 are formed to have such a shape that their contact area with the outer conductor 4 provided around the outer periphery of the insulating foam 3 is small (e.g., such a shape as to be in point contact with the outer conductor 4) at a cross section in a direction perpendicular to the longitudinal direction of the insulating foam 3. In other words, their contact area with the outer conductor 4 provided around the outer periphery of the insulating foam 3 is smaller than a contact area in an entire surface contact. Namely, the protruding portions 6 are formed to partially contact with the outer conductor 4. Thus, when an external force such as bending force or the like is applied to the coaxial cable 1, it is possible to reduce the frictional force caused between the outer conductor 4 and the insulating foam 3. Therefore, the insulation foam 3 is likely to slip in the outer conductor 4, and it is possible to further enhance the flexibility of the coaxial cable 1.

Another Embodiment According to the Present Invention

Although one embodiment according to the present invention has been explained in detail, the present invention is not intended to be limited to the embodiment described above, but appropriate modifications may be made without departing from the spirit thereof.

Figure 6:
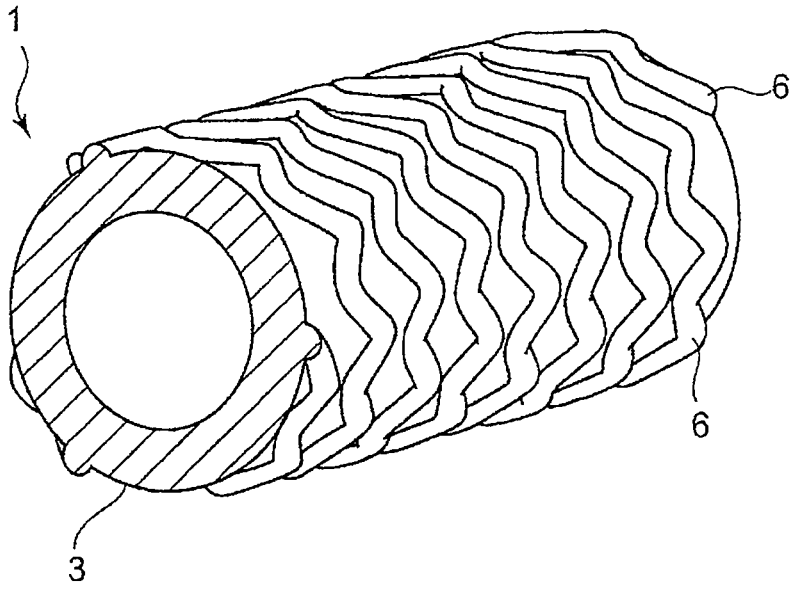
FIG. 6 is a schematic perspective view showing an insulating foam of a coaxial cable in another embodiment according to the present invention.

Although in the above embodiment, it has been described that the plurality of wavy protruding portions 6 are each formed to be parallel to each other in the longitudinal direction of the insulating foam 3, the present invention is not limited thereto. For example, as shown in FIG. 6, at least one wavy protruding portion 6 may be formed in a helical shape in the central axis direction of the insulating foam 3. That is, the wavy protruding portion 6 may be formed helically around the outer periphery of the insulating foam 3. This also allows the protruding portion 6 to be deformed when an external force such as bending force or the like is applied to the coaxial cable 1, therefore making it possible to improve the flexibility of the coaxial cable 1.

Although in the above embodiment, it has been described that the insulating foam 3 is formed by being foamed by physical foaming, the present invention is not limited thereto. That is, the insulating foam 3 may also be formed by chemical foaming.

Also, for example, if a copper pipe is used as the center conductor 2, the copper pipe may be corrugated. Thus, it is possible to further enhance the flexibility of the coaxial cable 1.

Although the invention has been described with respect to the specific embodiments for complete and clear disclosure, the appended claims are not to be thus limited but are to be construed as embodying all modifications and alternative constructions that may occur to one skilled in the art which fairly fall within the basic teaching herein set forth.

What is claimed is:

1. A coaxial cable, comprising:

a center conductor;

an insulating foam provided to cover an outer periphery of the center conductor; and a protruding portion provided around an outer surface of the insulating foam configured to absorb stress, wherein the protruding portion comprises a waved shape that oscillates in a circumferential direction of the insulating foam, wherein the protruding portion is provided in a longitudinal direction of the insulating foam, and includes periodic bends in the circumferential direction of the insulating foam.

2. The coaxial cable according to claim 1, wherein the protruding portion comprises a helical shape in a central axis direction of the insulating foam.

3. The coaxial cable according to claim 1, wherein the protruding portion comprises two or more protruding portions and a distance between adjacent protruding portions is not smaller than 1.5 mm and not greater than 10.75 mm.

4. The coaxial cable according to claim 1, further comprising:

an outer conductor provided around an outer periphery of the insulating foam to cover the outer periphery of the insulating foam, wherein the protruding portion comprises a shape in which a contact area with the outer conductor is smaller than a contact area in an entire surface contact at a cross section in a direction perpendicular to a longitudinal direction of the insulating foam.

5. A coaxial cable, comprising:

a center conductor;

an insulating foam provided to cover an outer periphery of the center conductor; and a protruding portion provided around an outer surface of the insulating foam configured to absorb stress, wherein the protruding portion comprises a waved shape that oscillates in a circumferential direction of the insulating foam, wherein a bend pitch of the protruding portion is not smaller than 10 mm and not greater than 20 mm.

6. The coaxial cable according to claim 1, wherein a height of the protruding portion is not smaller than 0.1 mm and not greater than 0.5 mm, and a width of the protruding portion is not smaller than 1.0 mm and not greater than 10 mm.

* * * * *